US008272524B2

(12) United States Patent
Alajlani et al.

(10) Patent No.: US 8,272,524 B2
(45) Date of Patent: Sep. 25, 2012

(54) FLOATING ROOF EMERGENCY DRAINING SYSTEM SEALING VALVE

(75) Inventors: Ibrahim L. Alajlani, Jeddah (SA); Ahmed Al Oufi, Rabigh (SA); Mohammed S. Banjar, Jeddah (SA)

(73) Assignee: Saudi Arabian Oil Company, Dhahran (SA)

( * ) Notice: Subject to any disclaimer, the term of this patent is extended or adjusted under 35 U.S.C. 154(b) by 517 days.

(21) Appl. No.: 12/381,354

(22) Filed: Mar. 10, 2009

(65) Prior Publication Data

US 2010/0230409 A1 Sep. 16, 2010

(51) Int. Cl.
*B65D 51/24* (2006.01)
*B65D 88/38* (2006.01)
*F16K 17/04* (2006.01)

(52) U.S. Cl. ..... 220/219; 220/203.23; 251/337

(58) Field of Classification Search ..... 220/203.23, 220/219, 203.27, 202, 220, 227, 203.19, 220/203.22, 216; 251/337; 222/549, 548
See application file for complete search history.

(56) References Cited

U.S. PATENT DOCUMENTS

| | | | | |
|---|---|---|---|---|
| 2,560,586 | A | 7/1951 | Michaels | |
| 2,563,017 | A * | 8/1951 | Feild | 220/219 |
| 2,913,138 | A | 11/1959 | Swick | |
| 2,931,534 | A | 4/1960 | Wiggins | |
| 3,883,032 | A | 5/1975 | Fisher | |
| 3,983,899 | A | 10/1976 | Graham et al. | |
| 4,134,515 | A * | 1/1979 | Hills et al. | 220/219 |
| 4,171,853 | A | 10/1979 | Cleaver et al. | |
| 4,325,406 | A | 4/1982 | Bron | |
| 4,402,340 | A | 9/1983 | Lockwood, Jr. | |
| 4,580,596 | A | 4/1986 | Stehling | |
| 5,176,464 | A | 1/1993 | Tanner | |
| 5,178,185 | A | 1/1993 | Stehling et al. | |
| 5,341,523 | A | 8/1994 | Barnes | |
| 5,662,139 | A | 9/1997 | Lish | |
| 5,901,742 | A * | 5/1999 | Kleppner et al. | 137/508 |
| 5,954,863 | A | 9/1999 | Loveless et al. | |
| 6,234,197 | B1 | 5/2001 | McKiernan et al. | |
| 6,341,622 | B1 | 1/2002 | McHugh | |

FOREIGN PATENT DOCUMENTS

JP 5077833 A 3/1993

* cited by examiner

*Primary Examiner* — Andrew Perreault
(74) *Attorney, Agent, or Firm* — Abelman, Frayne & Schwab

(57) ABSTRACT

A valve for a floating roof emergency drainage system for draining fluid accumulated atop the floating roof, including a valve body having a top part having a cylindrical bore of first diameter, a bottom part formed by a circumferential wall which extends axially downward from the top part and defines within the wall a cylindrical bore of second diameter that is generally coaxial with and greater than the first diameter, thereby defining at the junction of the top and bottom part bores a downward facing shoulder which serves as a valve seat, the circumferential wall of the bottom part having at least one fluid discharge passage extending transversely therethrough for discharge of the fluid from the valve, a valve seal element axially movable in the bottom part bore between an upper closed position where it abuts the shoulder, and a lower open position spaced axially downward from the upper closed position, and a spring mounted in the bottom part and constantly biasing the valve seal element toward the upper closed position, the valve seal element in the open position being at least partially below the fluid discharge passage in the bottom part bore, thus providing a passageway, when the valve seal element is in the open position, for fluid to flow through the top part bore, past the shoulder and to exit the valve via the fluid discharge opening.

24 Claims, 9 Drawing Sheets

FLOATING ROOF EMERGENCY DRAINING SYSTEM SEALING VALVE

I. BACKGROUND

A. Field of the Invention

This invention is in the field of liquid storage tanks with a double deck floating roof, and particularly a liquid petroleum storage tank with a floating roof and a drainage system to drain excess accumulation of water on top of the floating roof.

B. Background of the Invention

Storage tanks for oil and other liquid petroleum products are typically provided with a floating roof that covers and protects the liquid product, prevents the escape of harmful vapors, and moves vertically on the surface of the liquid product as its volume changes. A typical floating roof for covering a liquid product in a storage tank includes a deck that substantially conforms to the horizontal cross-sectional shape of the storage tank and has a vertical thickness. The roof is provided with one or more seals extending between the outer periphery of the floating roof and the inner walls of the tank. The roof floats on top of the stored liquid product and rises and falls as the amount of the liquid product increases and decreases. It is known to provide a drain pipe extending vertically through the top surface of deck to drain water accumulated on the top of the roof and to provide a passage or conduit for the water. The water drained from the surface of the roof passes through the stored liquid to a discharge outlet at the bottom of the tank where it is eventually drained from the tank.

During seasonal or other periods of heavy rains the amount of water that accumulates over the area of the tank cover can be substantially greater than that which can be removed by a centrally positioned basic drain. The water will therefore rise and can inundate the drain sealing mechanism. The presence of debris carried by the accumulating water can interfere with the proper operation of complex roof drain apparatus known to the prior art.

A further problem can occur when rainwater accumulates on the roof and its effective weight increases to a point where it can overcome the buoyancy of the roof, eventually forcing it into the liquid in the tank. It is therefore important to provide an effective and reliable means for draining water from the roof, so that it does not exceed a pre-determined depth and weight.

Various approaches have been proposed for draining water from storage tank floating roofs. For example, U.S. Pat. No. 2,560,586 to Michaels discloses a floating roof drain which drains water collected over a valve of the floating roof which closes and opens a drain passing. The weight of the water collected over the valve pushes down a cover against the buoyancy force of a float connected to the valve to allow the water collected to flow from the roof. The valve is again closed when the depth of the water on the roof decreases until it is no longer sufficient to hold the valve open against the buoyancy force of the float.

U.S. Pat. No. 2,913,138 to Swick describes floating covers for tanks in which a drainage device is located at a low point of the roof structure in a deck. The drainage device comprises a cylindrical sump, a sump bottom formed with a shallow depression which constitutes a downward flow passage, a cylindrical neck extending from the bottom of the sump and an annular float member loosely surrounding the sidewall of the neck. A mercury seal is provided on the bottom and the float member rests on the bottom of the pool of mercury. Accumulated water in the sump buoys up the float member to interrupt the mercury seal and thereby provide a conduit for water to drain across the surface of the pool.

U.S. Pat. No. 3,883,032 to Fisher discloses an automatic drain valve for a floating roof which includes an orifice and a larger disk located under the orifice. A float attached to the disk allows the valve to be biased closed, and water gathered on top of the roof will open the valve which permits the water to drain through the roof into the tank beneath.

Japanese Patent No. JP5077883 to Kunio discloses an emergency drain device for a floating roof in which a drain pipe runs through a deck to stored liquid in a tank. A float element adjacent the upper end of the drain pipe floats on accumulated liquid on the deck. A weight-attached guide member makes the float return to the upper end of the drain pipe to prevent vapor from flowing out of the drain pipe.

The above systems for draining water from floating roofs do not provide desired reliability, reduction of hazardous conditions resulting from accumulated hydrocarbon vapors, secured sealing against evaporation losses, and performance under extreme conditions such as high winds and a significant accumulation of rainwater.

It is therefore, an object of the present invention to provide an apparatus for effectively and reliably draining accumulated rain water from a floating roof on a liquid product tank by a self-opening and closing mechanism for a floating roof drain.

An additional object is to provide for a floating roof an emergency drainage system which will automatically open in a predetermined condition.

A still further object is to provide an uncomplicated but reliable emergency drainage system which will be normally closed from a compression spring and will automatically open merely from the accumulation of a predetermined head of water on the roof in the vicinity of the emerging drainage valve.

Another object of the invention is to provide an apparatus for draining accumulated rain water from the top of a roof on a liquid product storage tank and reduction of the hazardous condition of accumulated hydrocarbon vapors and their evaporation to the atmosphere.

A further object of the invention is to provide an automatic roof drain valve that is of simple and rugged construction and inexpensive to manufacture and install, such valve being made of a durable material such as carbon graphite that is corrosion and chemical resistant.

II. SUMMARY OF THE NEW INVENTION

The above objects, as well as the advantages described herein, are achieved by a new emergency drainage valve installed in a floating roof, where a sealing disk has an upper closed position where it abuts and seals against an internal circular shoulder, and a lower open position where it exposes side-facing discharge openings allowing flow of the accumulated water to a drain conduit extending through the tank to an exit opening at the bottom of the tank or at another elevation below the floating roof.

In one preferred embodiment the bottom of the valve body consists merely of a set of legs extending downward from the upper part of the base and spaced apart as partial circumferential shells extending circumferentially an amount in the range of 10 to 90 degrees, with elongated apertures extending between opposite edges of each two adjacent shell walls.

In another preferred embodiment of the new emergency drain valve the sealing disk is spring-biased to its upper closed position by a spring that extends from below the sealing disk to a spring support bar that extends transverse of the bottom of the valve body.

In a still further preferred embodiment the valve base is a one piece molded piece whose top part has a bore surface and whose bottom part has a larger and concentric base surface, with the junction bore surface forming a downward facing shoulder that serves as the valve sealing seat against which is urged the valve sealing disk.

In another preferred embodiment the new valve for a floating roof emergency drainage system for draining fluid accumulated atop said floating roof, comprises:

a. a valve body having:

i. a top part having a cylindrical bore of first diameter, ii. a bottom part formed by a circumferential wall which extends axially downward from said top part and defines within said wall a cylindrical bore of second diameter that is generally coaxial with and greater than said first diameter, thereby defining at the junction of said top and bottom part bores a downward facing shoulder which serves as a valve seat, b. said circumferential wall of said bottom part having at least one fluid discharge passage extending transversely therethrough for discharge of said fluid from said valve, c. a valve seal element axially movable in said bottom part bore between (i) an upper closed position where it abuts said shoulder, and (ii) a lower open position spaced axially downward from said upper closed position, and d. a spring mounted in said bottom part and constantly biasing said valve seal element toward said upper closed position, e. said valve seal element in said open position being at least partially below said fluid discharge passage in said bottom part bore, thus providing a passageway, when said valve seal element is in said open position, for fluid to flow through said top part bore, past said shoulder and to exit said valve via said fluid discharge opening.

In a still further embodiment the new valve for a floating roof emergency drainage system, comprises:

a. a valve body having:

i. a top part with a downward extending bore therethrough, ii. a bottom part comprising a set of at least two legs which extend downward from said top part and are circumferentially spaced apart to define between them two transversely extending fluid discharge passages extending radially outward from said bore, said legs having facing surfaces that define a downward extending lower bore therebetween, and iii. a downward facing valve seat situated in said lower bore, b. a valve seal element axially movable in said bottom part bore between (i) an upper closed position where it abuts said valve seat, and (ii) a lower open position spaced axially downward from said upper closed position, and c. a spring mounted in said bottom part and constantly biasing said valve seal element toward said closed position, d. said valve seal element in said open position being at least partially below said fluid discharge passages in said bottom part bore.

The present invention includes the new emergency valve as described herein, and/or in combination with a floating roof for an oil or other liquid hydrocarbon, and/or in combination with such floating roof and such storage tank. The new valve is biased to a normal closed state to bar escape of dangerous hydrocarbon gases, while allowing accumulated water atop the floating roof to flow downward, safely through the floating roof and through the tank via a drain tube to an exit discharge opening. After such flow from accumulated water the valve automatically returns to its closed state to bar further escape of hydrocarbon gases.

The valve, as illustrated herein, conveniently has a round cylindrical body with a round cylindrical bore and a round disk seal element. Following the principles, herein, these shapes may vary. In particular, the lower part of this valve is shown as two arcuate legs extending downward from the top part, with the spaces between the legs being the valve discharge openings. Alternatively, the legs could be wider, thinner or more or fewer; also, this lower part could be a full cylindrical cylinder with transversely extending windows for the discharge openings. Also, the seal element which reacts to a head of water on the floating roof may react directly to the weight of the water or to a sensor of another type, combined with a spring of many optional types or with a motorized or other drive means.

III. BRIEF DESCRIPTION OF THE DRAWINGS

FIG. 1 is a top perspective view showing schematically a floating roof atop a liquid petroleum products tank with an emergency drainage valve in the floating roof, FIG. 2 is a front elevation view enlarged and in section of the emergency valve of FIG. 1 shown in its closed condition, FIG. 3 is a front elevation sectional view taken through said valve along line 3-3 in FIG. 2, similar to FIG. 2 showing the valve in its open condition, FIG. 4 is a bottom plan view of the valve of FIG. 2 with the spring support beam in its start-assembly position.

IV. DETAILED DESCRIPTION OF THE PREFERRED EMBODIMENTS

For convenience and clarity in describing these embodiments, similar elements or components appearing in different figures will have the same reference numbers.

The preferred embodiment of the new floating roof emergency drainage system is illustrated in FIGS. 1-6.

Figure 1:
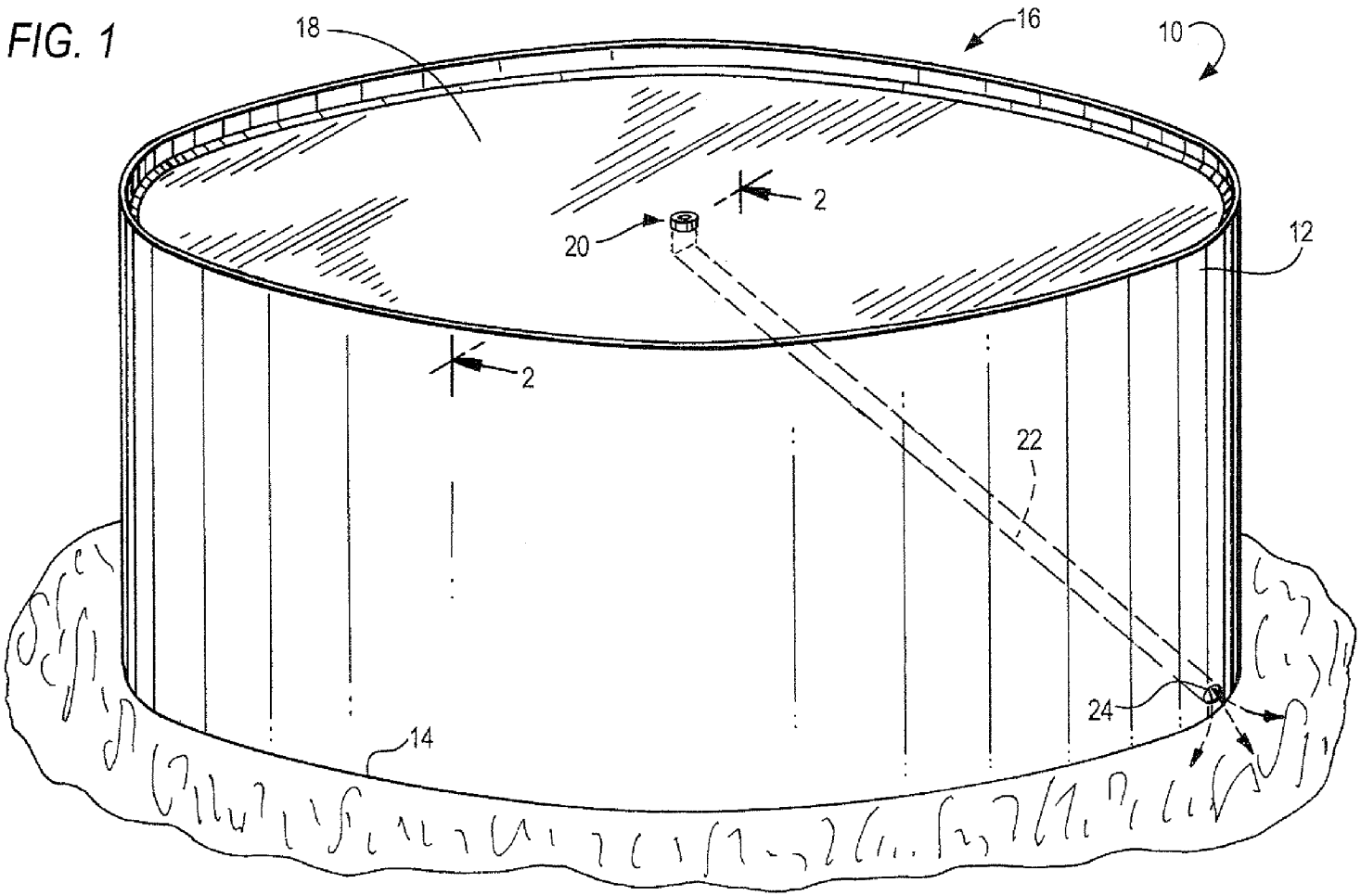

FIG. 1 shows a conventional liquid petroleum fluid storage tank 10 with fixed circumferential walls 12, a closed bottom 14, an open top 16, a floating roof 18, the new emergency drainage valve 20, and a conventional drainage duct 22 extending from said emergency drainage valve 20 to the bottom drainage outlet 24.

Figure 2:
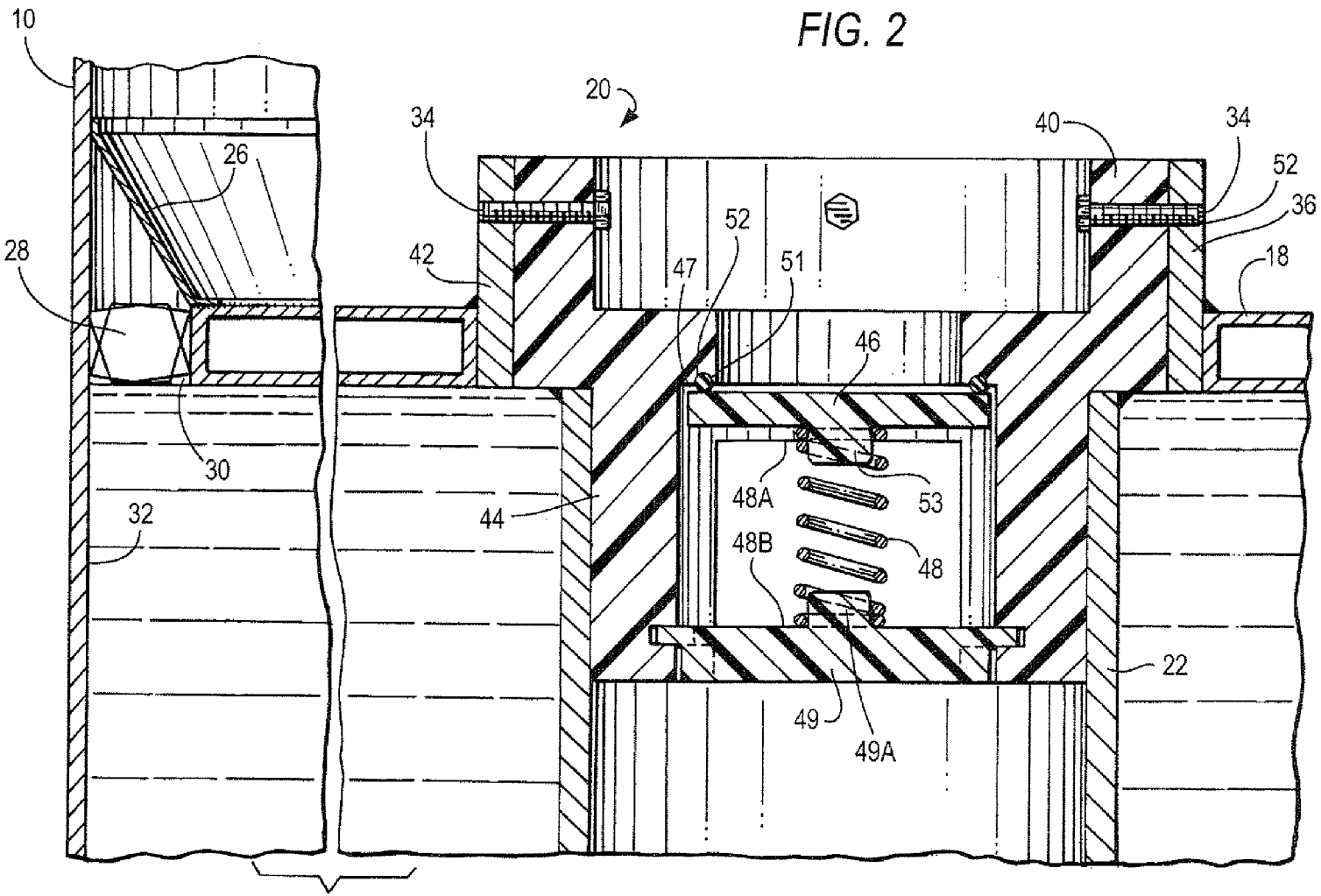

FIG. 2 illustrates in greater detail the tank 10 where floating roof 18 has seal element 26 around its circumferential edge and bumpers 28 between the outer edge 30 of floating roof 18 and inner wall surface 32 of tank 10.

Shown schematically in FIG. 2 in the center of roof 10 is the new emergency drainage valve 20 which is secured by bolts 34 to mounting sleeve 36 which is secured to roof 18. As will be described in detail later and indicated in FIGS. 5 and 6, the valve has side openings 38 at an elevation generally below the bottom 14 of floating roof 10.

Figure 3:
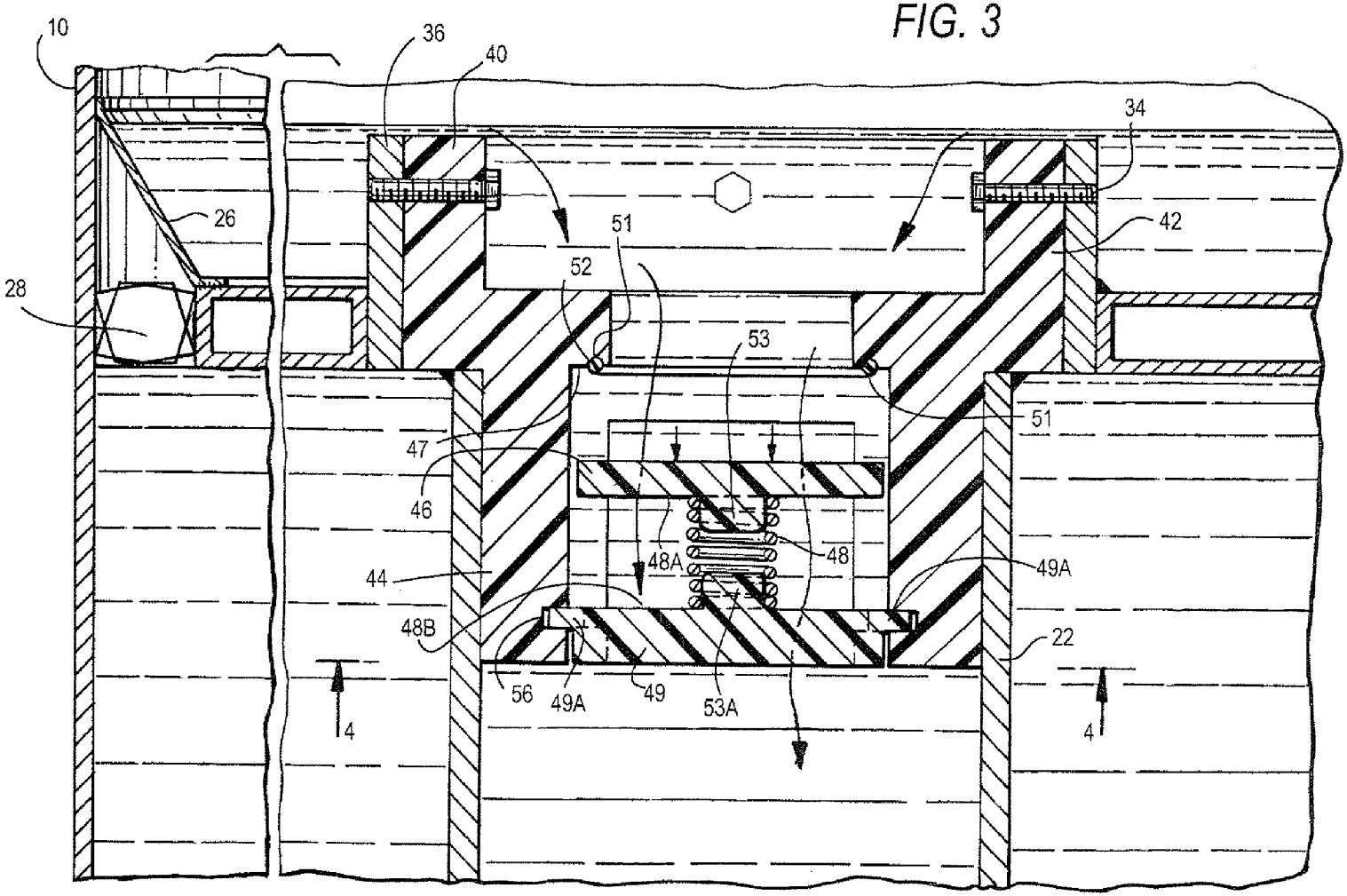

FIG. 2 further shows the new emergency valve 20 with its sealing disk 46 in its upper closed position, FIG. 3 shows a side elevation view of valve 20 in its open position, and FIG.

5 shows in end elevation view valve 20 also in its open position, with water flowing downward through the valve.

As seen in FIGS. 2-6 the new emergency valve is formed of a body 40 having a top cylindrical part 42, bottom partially cylindrical part 44, a sealing disk 46, seat or inner shoulder 47, spring 48 and spring support 49. The valve body 40 may be constructed of top and bottom components 42, 44 as shown; however, it is preferred for manufacture and assembly benefits, to employ a one-piece molded body. Sealing disk 46 is slidable in lower part 44 between an upper and closed position where the peripheral edge of disk 46 abuts a circular shoulder as seat 47. For more secure valve sealing there is included O-ring 51 mounted in a downward facing groove 52 in shoulder 47.

As seen in FIG. 2 valve disk 46, in its upper closed position, abuts seat 47 and is slidable downward to its open position (FIG. 3).

Valve disk 46 is biased or urged by spring 48 to remain in said closed position unless and until it is driven downward by a sufficient head of water that accumulates atop said valve disk 46. When the downward force of the accumulated water exceeds the upward force of spring 48, valve disk 46 will descend and allow the emergency drainage of water from atop floating roof 10 to drainage duct 22.

The spring 48 illustrated herein is a common coil spring whose top end 48A is coupled to a downward extending projection 53. The bottom end 48B of spring 48 is coupled to an upward extending projection 53A on spring support bar 49.

For convenience of assembly of the illustrated embodiment of the new emergency valve, spring support bar 49, as seen in FIGS. 2-6 is an elongated member whose ends 49A slide rotatably in groove 56 in the wall surface of the lower part 44 of valve body 40.

Figure 4:
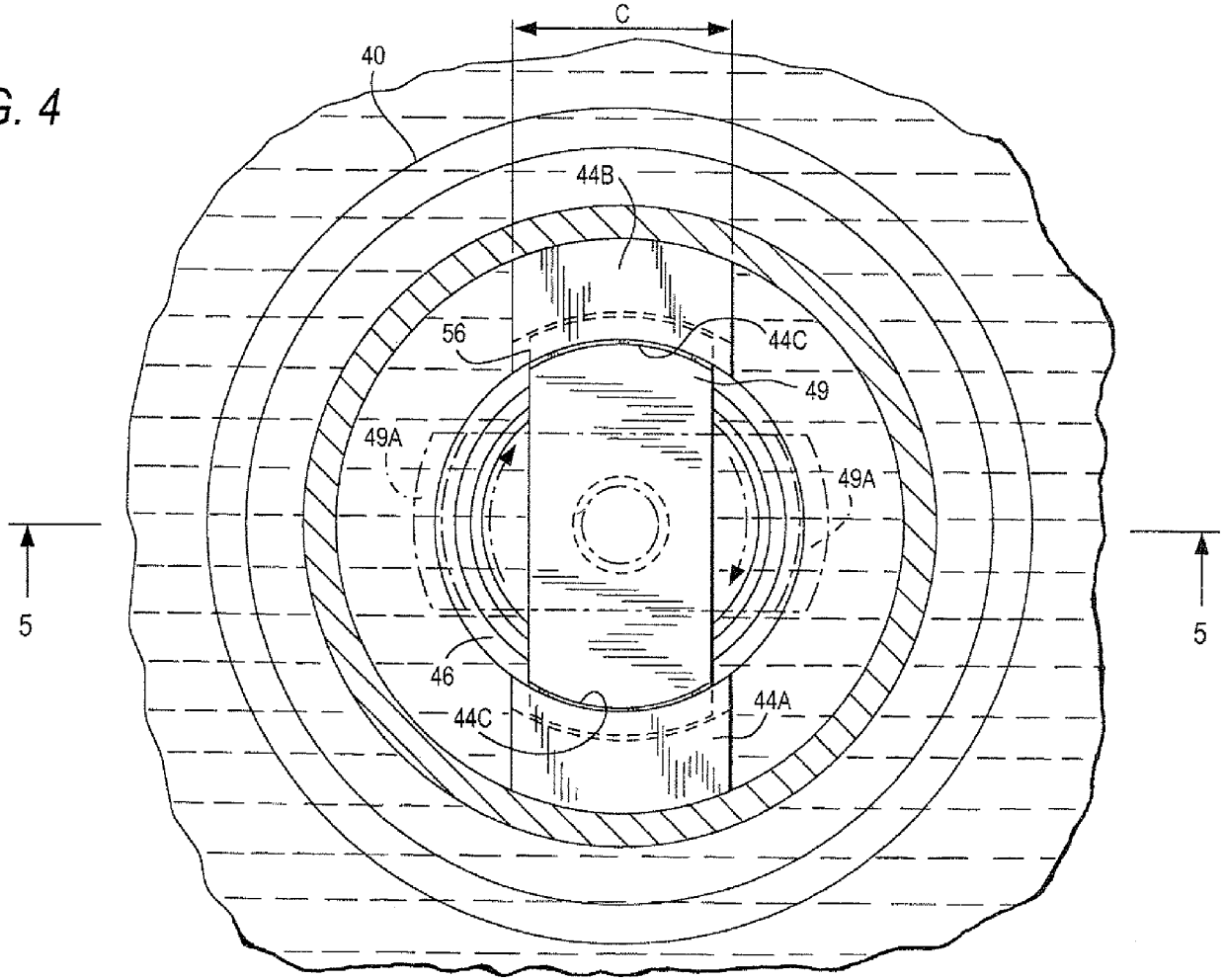
Figure 4A:
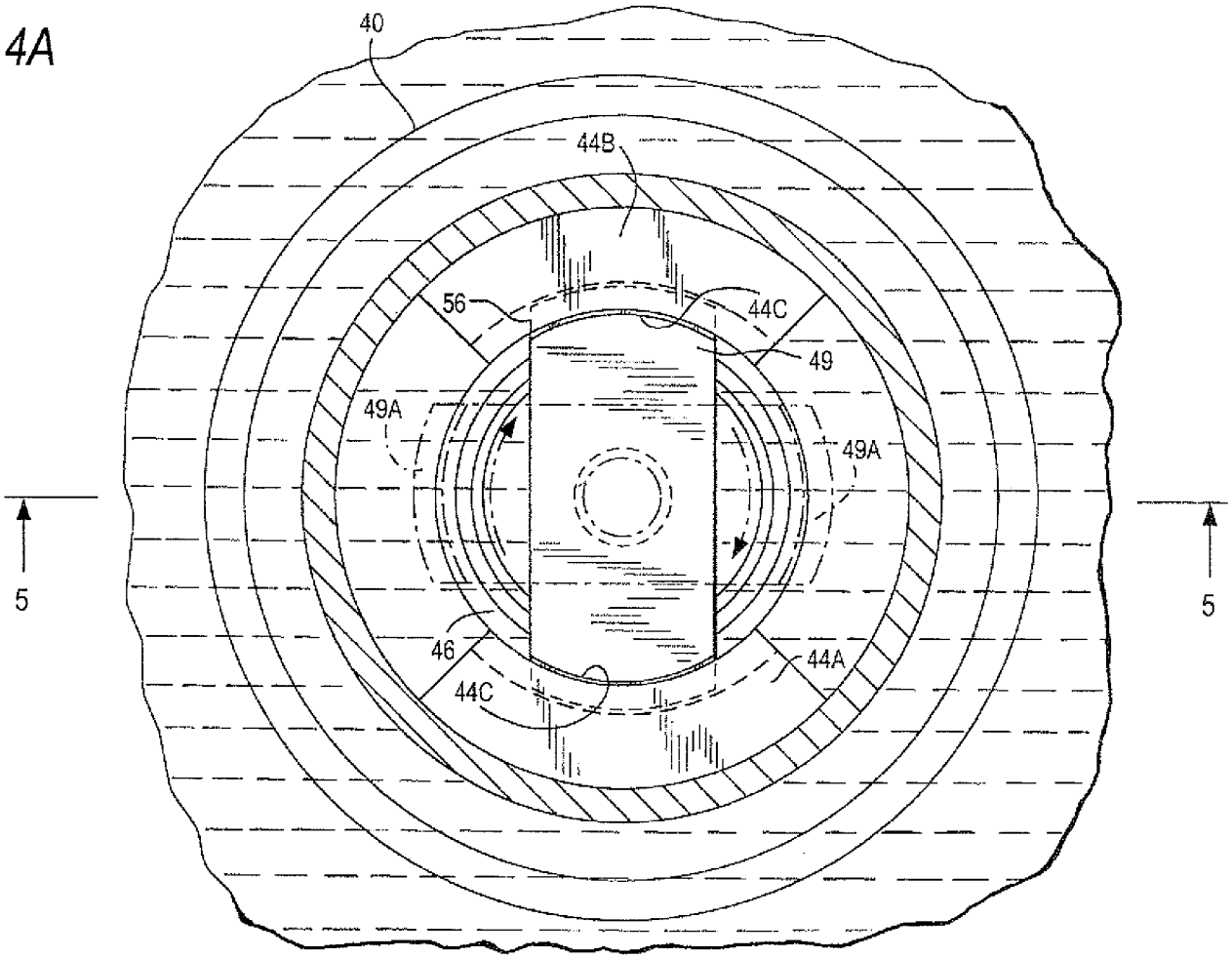
Figure 4B:
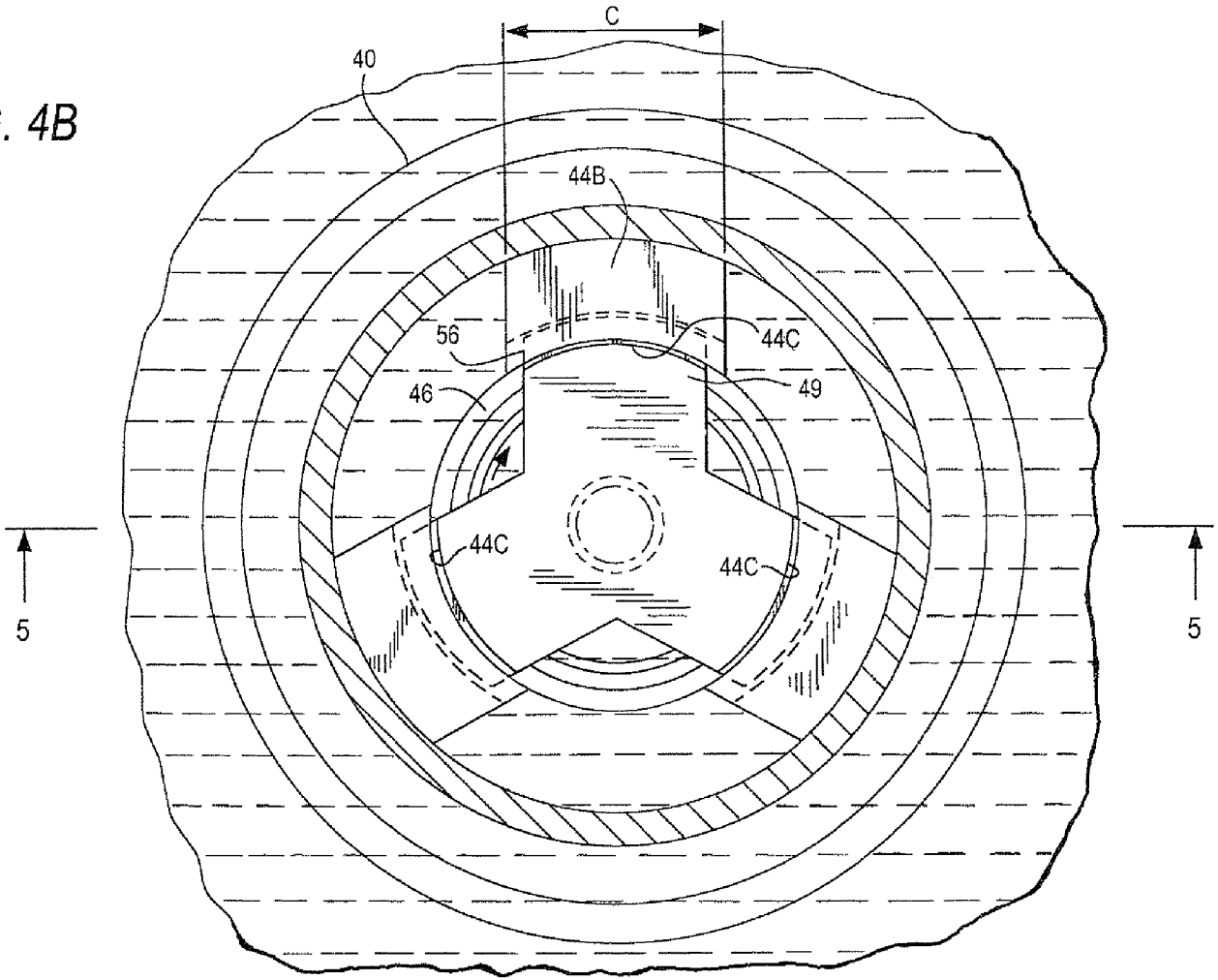

FIG. 4 shows spring support bar 49 in dashed line at its start position with ends 49A still in the space between curved legs 44A, 44B of the lower part.

Figure 5:
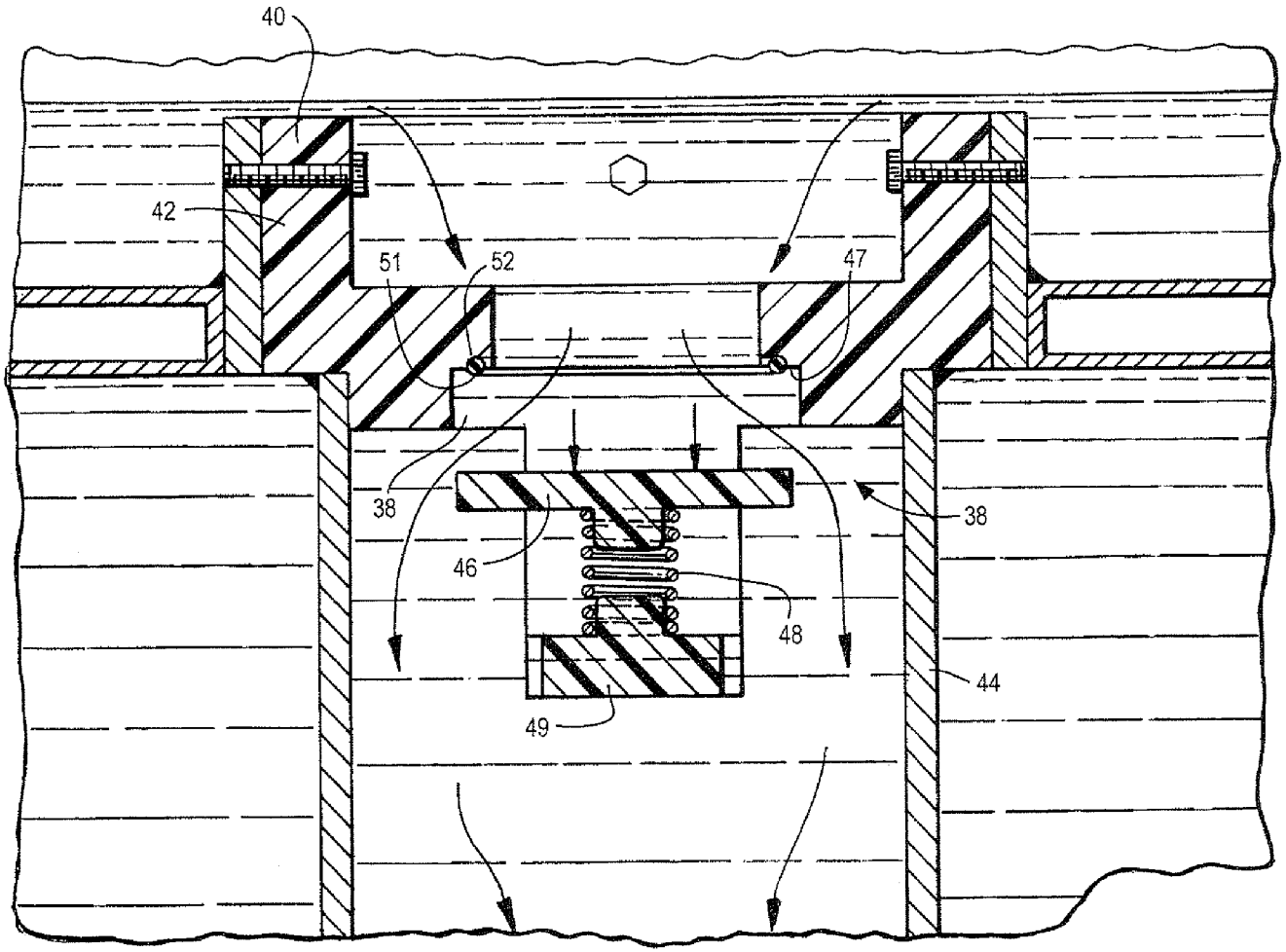
FIG. 5 is similar to FIG. 2 and is an elevation view in section taken along line 5-5 in FIG. 4, showing the valve in its open condition and the pattern of liquid flow through the valve.
Figure 6:
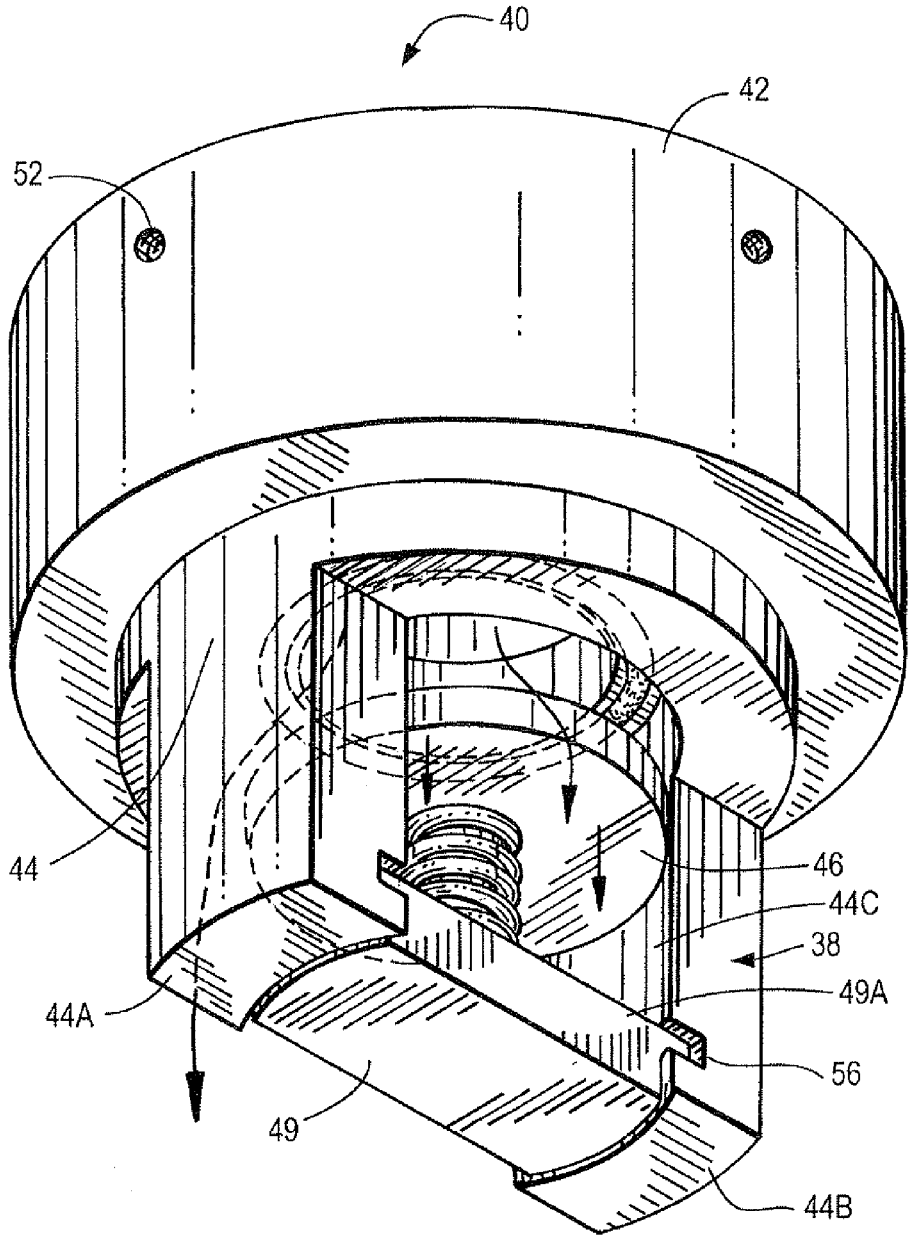
FIG. 6 is a bottom perspective view of the valve of FIG. 5, with the spring support rotated to its assembled position.

FIGS. 5 and 6, and FIG. 4 in dashed line, show spring support bar 49 rotated about 90° to its final position with ends 49A in groove 56. Friction or other means may be used to secure support bar 49 in this position. As seen in FIGS. 4 and 6, the curved inner wall surfaces 44C of legs 44A, 44B provide the guide surface support for sliding movement of disk 46, as forced and further guided by spring 48.

As further seen in FIGS. 4-6 the two clear spaces or windows 38 in between adjacent sides of the legs 44A, 44B of the lower part 44 of the valve body 40, provide the discharge apertures for water when the valve disk is in its descended state. The width of legs 44A, 44B in the circumferential direction may vary in the range of about 10 to 90 degrees as indicated by arrow C in FIG. 4, with greater width chosen for providing greater sliding support and guidance for the disk, and lesser width chosen for providing larger water discharge windows. The distance disk 46 descends will depend on the head of water above and the spring force below.

The bottom portion of valve body 40 is coupled to the outer discharge duct 22 which then extends through the tank 10 to an exit aperture beneath or at the side of the tank wall 12.

The valve body may take various forms so long as there is structure for opening and closure of the flow path. The valve body illustrated in FIGS. 1-6 has upper and lower walls of generally similar thickness, for ease in molding and consistency in strength. The top of body 40 includes bolt holes 35 for releasable attachment of this valve body to floating roof 10. The size and nature of the roof and the quantity and frequency of excessive water accumulation will determine the size and number of emergency drain valves to use and the release or pressure force to set with the valve closure springs.

Figure 7:
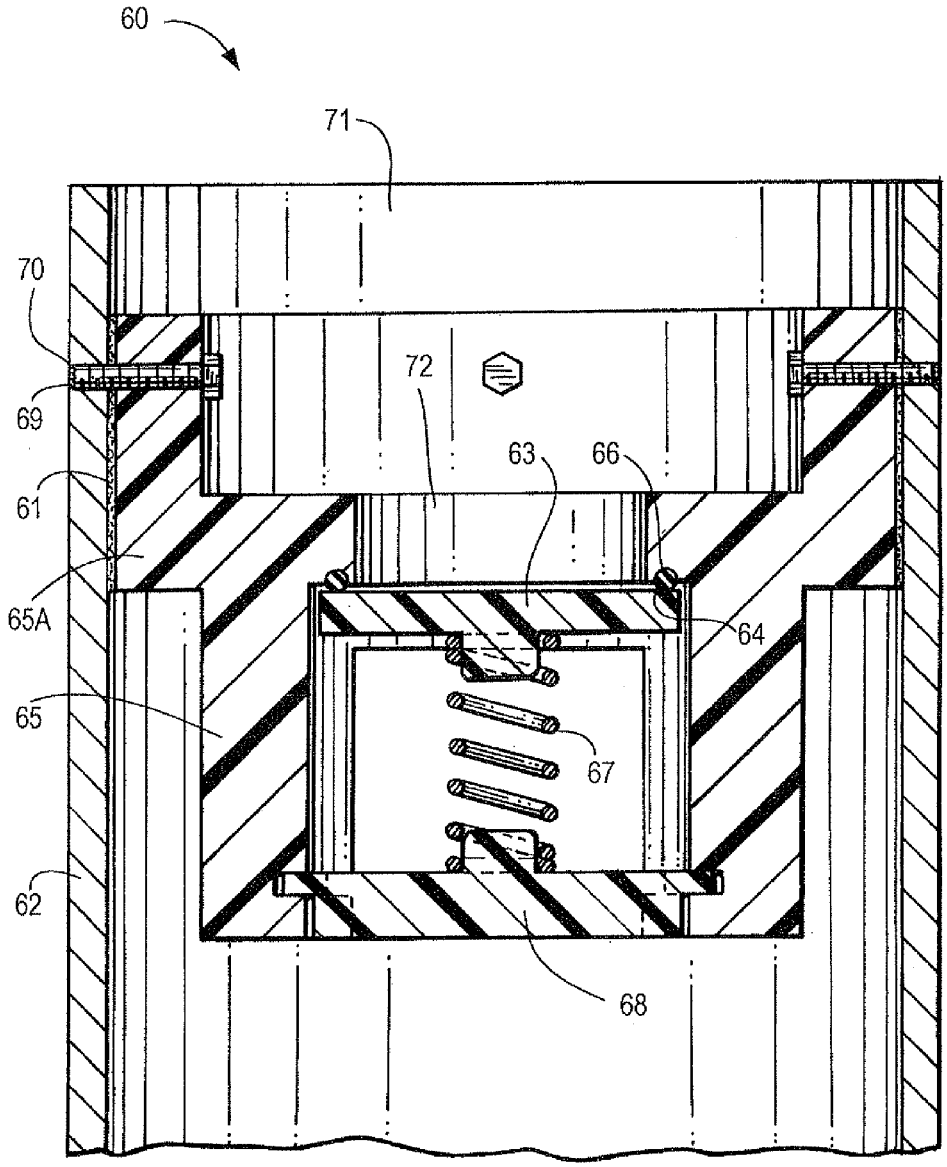
FIG. 7 is a front elevation view in section generally similar to FIG. 2 but of a second embodiment of the new emergency drainage valve.

FIG. 7 illustrates a second embodiment 60 of the new floating roof emergency drainage valve corresponding in part to the emergency drainage valve 20 of FIG. 2. The valve in FIG. 7 is shown within a segment 61 of drain pipe 62 that extends downward through the storage tank (not shown). Sealing disk 63 is shown in its upper closed position against shoulder 64 of the upper part 65A of valve body 65 and seal ring 66. Sealing disk 63 is situated in this position by the resilient upward force of spring 67 whose lower end bears against support 68 that is maintained in valve body or housing 65. Bolts 69 secure valve body 65 to drain pipe 62. Sealant 70 is included between the outer wall surfaces of body 65 and the inner wall surfaces of drain pipe 62 in the area where body 65 engages pipe 62.

Operation of valve 60 is generally similar to that of valve 20 in FIGS. 1-6, where the weight of accumulated water 71 on the top surface of sealing disk 63 will urge disk downward to open valve 60. One difference between the valve 60 in FIG. 7 and valve 20 of FIGS. 1-6 is the engagement of valve body 65 by only its upper part 65A with the bore of drain pipe 62, as compared to the engagement of upper and lower valve body parts with mounting sleeve 36 and drain duct 22 respectively.

While the invention has been described in conjunction with several embodiments, it is to be understood that many alternatives, modifications, and variations will be apparent to those skilled in the art in light of the foregoing description. Accordingly, this invention is intended to embrace all such alternatives, modifications, and variations which fall within the spirit and scope of the appended claims.

The invention claimed is:

1. A valve for a floating roof emergency drainage system for draining fluid accumulated atop said floating roof, comprising:

a. a valve body having:
   i. a top part having a cylindrical bore of first diameter,
   ii. a bottom part formed by a circumferential wall which extends axially downward from said top part and defines within said wall a cylindrical bore of second diameter that is generally coaxial with and greater than said first diameter, thereby defining at the junction of said top and bottom part bores a downward facing shoulder which serves as a valve seat, b. said circumferential wall of said bottom part having at least one fluid discharge passage extending transversely through said circumferential wall for discharge of said fluid from said valve, c. a valve seal element axially movable in said bottom part bore between (i) an upper closed position where it abuts said shoulder, and (ii) a lower open position spaced axially downward from said upper closed position, and d. a spring mounted in said bottom part and constantly biasing said valve seal element toward said upper closed position, e. said valve seal element in said open position being at least partially below said fluid discharge passage in said bottom part bore, thus providing a passageway, when said valve seal element is in said open position, for said fluid accumulated on said roof to flow downward through said top part bore, past said shoulder and to exit said valve via said fluid discharge opening.

2. A valve according to claim 1 wherein said top and bottom of said valve body and said junction and downward facing shoulder comprise a continuous one piece molded element.

3. A valve according of claim 1 wherein said valve body and valve seal element have a common central longitudinal axis, and said spring extends generally coaxially with said central axis.

4. A valve according to claim 3 further comprising a spring support bar extending transversely of said central longitudinal axis at an elevation below said valve seal element, and wherein said spring is an axial compression spring having a top end engaging and urging said valve seal element upward to seal against said downward facing shoulder and an opposite bottom end engaging said spring support bar.

5. A valve for a floating roof emergency drainage system, comprising:

a. a valve body having:

i. a top part with a downward extending bore therethrough, ii. a bottom part comprising a set of at least two legs which extend downward from said top part and are circumferentially spaced apart to define between them two transversely extending fluid discharge passages extending radially outward from said bore, said legs having facing surfaces that define a downward extending lower bore therebetween, and iii. a downward facing valve seat situated in said lower bore, c. a valve seal element axially movable in said bottom part bore between (i) an upper closed position where it abuts said valve seat, and (ii) a lower open position spaced axially downward from said upper closed position, and d. a spring mounted in said bottom part and constantly biasing said valve seal element toward said closed position, e. said valve seal element in said open position being at least partially below said fluid discharge passages in said bottom part bore.

6. A valve according to claim 5, wherein said legs extend circumferentially with generally equal distances between adjacent sides of each two legs, defining the widths of said fluid discharge passages.

7. A valve according to claim 5 wherein said valve body further comprises a spring support bar extending transversely across and fixed to said annular base part, said spring extending from said spring support bar upward to the bottom of said disk, constantly urging said valve seal element upward against said shoulder for closing said valve.

8. A valve according to claim 5, wherein each of said legs extends circumferentially an amount in the range of about 10 to 90 degrees.

9. A valve according to claim 7, further comprising first spring engagement means on the top of said spring support bar, and second spring engagement means at the bottom of said valve seal element.

10. A valve according to claim 5, wherein said set of at least two legs comprises two legs circumferentially spaced apart 180 degrees.

11. A valve according to claim 10, wherein each of said two legs extends circumferentially about 90 degrees.

12. A valve according to claim 5, wherein said set of at least two legs comprises three legs circumferentially spaced apart with generally equal distances between them.

13. A valve according to claim 5, further comprising a shaft extending from the bottom of said valve seal element downward to and through said spring support bar and slidable therethrough when said valve seal element is moved downward, said shaft helping to guide said with said legs when said valve seal element is moved downward.

14. A valve according to claim 7, wherein said spring support bar comprises a beam having opposite ends, and said legs each includes a circumferential groove extending radially outward, said beam being movable axially upward such that said opposite ends thereof move between said legs of said valve, said being then being rotatable about the central longitudinal axis of the valve base with said opposite ends of said beam being insertable and securable into said grooves.

15. A valve for a floating roof emergency drainage system to drain fluid accumulated atop said floating roof, comprising:

a. a valve body having:

a top part having a downward extending bore therethrough, and ii. a bottom part formed by a circumferential wall which extends axially downward from said top part and defines within said circumferential wall a bore that is generally coaxial with said top part bore and defines at the junction of said top and bottom part bores a downward facing shoulder which serves as a valve seat, b. said circumferential wall of said bottom part having at least one fluid discharge opening extending transversely through said circumferential wall and communicating with said bottom part bore, c. a valve seal element axially movable in said bottom part bore between (i) an upper closed position abutting said valve seat, and (ii) a lower open position spaced axially downward from said upper closed position, said valve seal element being automatically opened when a predetermined head of fluid accumulates on said floating roof above said valve, d. valve drive means carried by said valve body for automatically moving said valve seal element between said open position to said closed position after said accumulated fluid has flowed and been discharged through said valve.

16. A valve according to claim 15, wherein said valve seal element in said open position being at least partially below said fluid discharge opening in said bottom part bore.

17. A valve according to claim 15, wherein said top part bore has first cross-section, said bottom part bore has cross-section that is generally coaxial with and greater than said first cross-section, thereby defining as the junction of said top and bottom part bores said downward facing shoulder.

18. A valve according to claim 15 wherein said bottom part bore is circular and said valve seal element has a corresponding circular shape for sliding axially in said bottom part bore.

19. A valve according to claim 15 wherein said valve drive means comprises a spring mounted in said bottom part and constantly urging said valve seal element toward its closed position.

20. A valve according to claim 15 wherein said spring comprises an axially extending coil spring and said valve body further comprises a bar mounted below said spring and extending transversely thereof.

21. A valve according to claim 20 wherein said valve seal element is a disk.

22. A valve according to claim 15, further comprising roof-engagement means on said valve base body for securing said valve to said floating roof.

23. A floating roof and emergency drain assembly for draining fluid accumulated atop said floating roof, comprising:

a. a floating roof for covering the top surface of fluid in said storage tank, and b. an emergency drainage valve secured to said floating roof and adapted to discharge to a drainage duct below said valve, said valve comprising:

(1) a valve body having:

i. a top part having a cylindrical bore of first diameter, ii. a bottom part formed by a circumferential wall which extends axially downward from said top part and defines within said wall a cylindrical bore of second diameter that is generally coaxial with and greater than said first diameter, thereby defining at the junction of said top and bottom part bores a downward facing shoulder which serves as a valve seat, (2) said circumferential wall of said bottom part having at least one fluid discharge passage extending transversely through said circumferential wall for discharge of said fluid from said valve, (3) a valve seal element axially movable in said bottom part bore between (i) an upper closed position where it abuts said shoulder, and (ii) a lower open position spaced axially downward from said upper closed position, and (4) a spring mounted in said bottom part and constantly biasing said valve seal element toward said upper closed position, (5) said valve seal element in said open position being at least partially below said fluid discharge passage in said bottom part bore, thus providing a passageway, when said valve seal element is in said open position, for fluid to flow through said top part bore, past said shoulder and to exit said valve via said fluid discharge opening.

24. A liquid petroleum storage system, comprising:

a. a storage tank having enclosing walls, a bottom, a floating roof, fluid inlet and outlet means, and b. a valve for a floating roof emergency drainage system for draining fluid accumulated atop said floating roof, comprising:

a valve body having:

i. a top part having a cylindrical bore of first diameter, ii. a bottom part formed by a circumferential wall which extends axially downward from said top part and defines within said wall a cylindrical bore of second diameter that is generally coaxial with and greater than said first diameter, thereby defining at the junction of said top and bottom part bores a downward facing shoulder which serves as a valve seat, c. said circumferential wall of said bottom part having at least one fluid discharge passage extending transversely through said circumferential wall for discharge of said fluid from said valve, d. a valve seal element axially movable in said bottom part bore between (i) an upper closed position where it abuts said shoulder, and (ii) a lower open position spaced axially downward from said upper closed position, and e. a spring mounted in said bottom part and constantly biasing said valve seal element toward said upper closed position, f. said valve seal element in said open position being at least partially below said fluid discharge passage in said bottom part bore, thus providing a passageway, when said valve seal element is in said open position, for fluid to flow through said top part bore, past said shoulder and to exit said valve via said fluid discharge opening.

* * * * *